United States Patent [19]

Greten et al.

[11] 4,339,478

[45] Jul. 13, 1982

[54] INSTALLATION AND PROCESS FOR PROCESSING OF LIGNO-CELLULOSE FOR THE MANUFACTURE OF WOOD-PRODUCT PLATES

[75] Inventors: Berndt Greten; Harry Neubauer; Günter Seeger; Günter Bücking; Hans J. Komp; Wilhelm Oldemeyer, all of Springe, Fed. Rep. of Germany

[73] Assignee: Bison-werke Bähre & Greten GmbH & Co. KG, Springe, Fed. Rep. of Germany

[21] Appl. No.: 143,166

[22] Filed: Apr. 23, 1980

[30] Foreign Application Priority Data

Apr. 24, 1979 [DE] Fed. Rep. of Germany ..... 2916541

[51] Int. Cl.[3] ..... B05D 7/00

[52] U.S. Cl. ..... 427/212; 118/35; 118/58; 118/303; 118/418; 118/603; 118/610; 156/62.2; 427/291; 427/317

[58] Field of Search ..... 118/58, 35, 303, 418, 118/603, 610; 156/62.2; 427/291, 212, 389, 317

[56] References Cited

U.S. PATENT DOCUMENTS 3,164,511 1/1965 Elmendorf ..... 428/337 X

*Primary Examiner*—Bernard D. Pianalto

*Attorney, Agent, or Firm*—Max Fogiel

[57] ABSTRACT

An arrangement for processing ligno-cellulose containing particles for the manufacture of wood-product plates. These have layers of oriented chips, and a chipper comminutes raw material. The fine material and dust are separated by a sifting device, and the sifted chips are provided with binder material by a gluing device. The chipper produces more chips of as great a length as possible than are required for forming of at least one cover layer of a mat. Behind the chipper, there are provided a wet-chip bunker and a dryer. The sifter separates the chips, obtained after removal of the fine material and the dust, into two fractions. The chip composition of one of these fractions, during the processing time, constantly contains chips which are as long as possible and which are more than that required for forming the mat layer. The other fraction has shorter chips obtained during chipping, and both fractions are present each in at least one bunker. A feeder supplies a part of the chips that are as long as possible from the first fraction to the chips of the second fraction. The feeder may be arranged between the sifter and the bunkers.

3 Claims, 3 Drawing Figures

FIG. 1
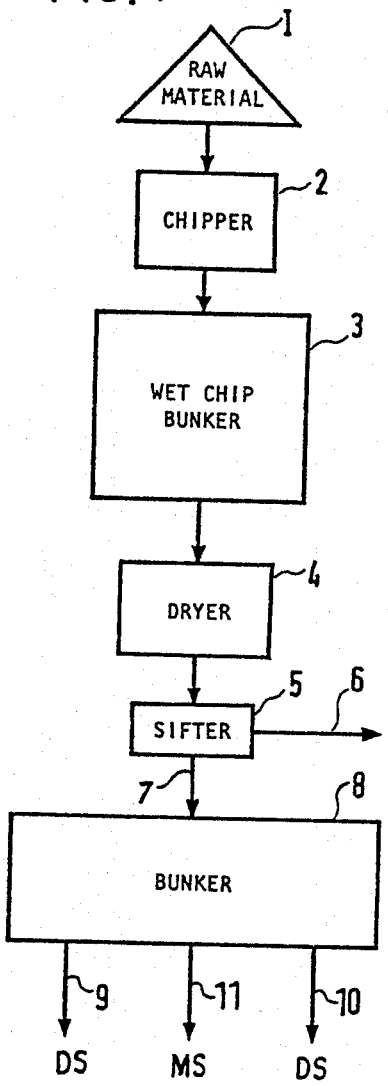
FIG. 2
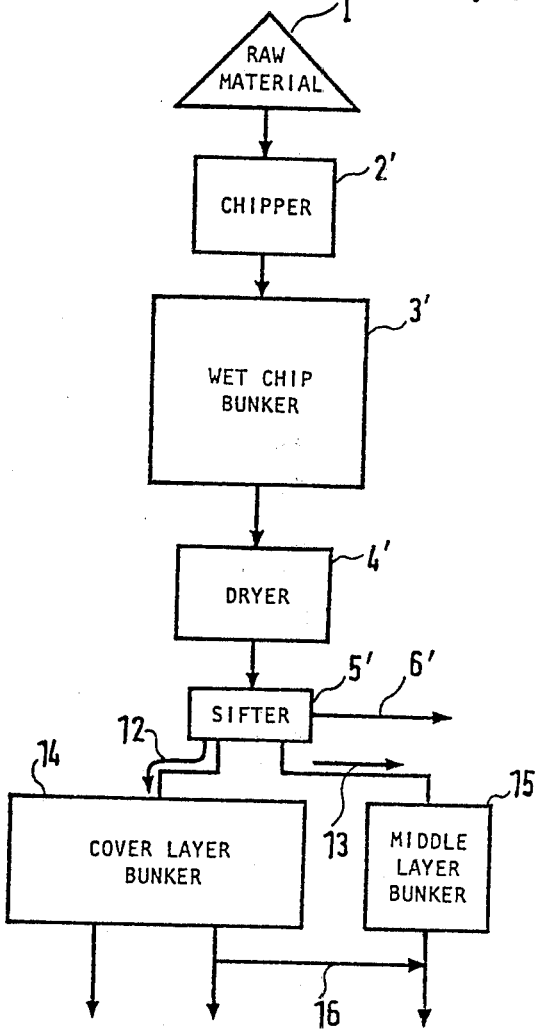
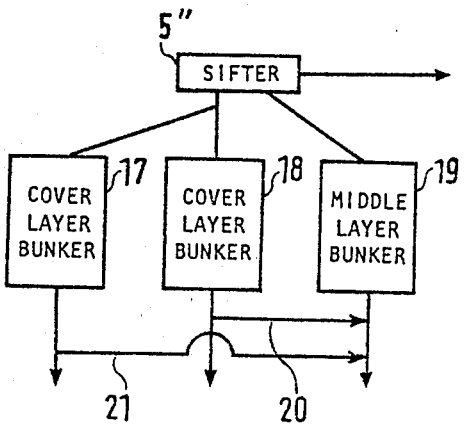
FIG. 3

INSTALLATION AND PROCESS FOR PROCESSING OF LIGNO-CELLULOSE FOR THE MANUFACTURE OF WOOD-PRODUCT PLATES

BACKGROUND OF THE INVENTION

The invention relates to an installation for the processing of ligno-cellulose containing particles for the manufacture of wood-product plates or the like, which have layers formed from oriented chips or the like, with at least one raw material-comminuting chipper, with a sifting device serving to segregate fine material and dust, and with at least one gluing device supplying sifted chips or the like with at least one binder material. The sifted and glued chips are then supplied to a device which so orients the chips of each layer parallel to one another (German Allowed Application No. 17 03 832, German Published Application No. 27 34 403), that wood product plates (U.S. Pat. No. 3,164,511) can be produced.

As far as known, the chips required for the manufacturing of such wood-product plates hereafter were produced only in laboratory applications, in order to permit testing the developed orientation devices. During the continuous tests for such orientation devices it was found that the longitudinal bending strength of wood product plates produced with such chips changed during the laboratory tests, which is unsatisfactory. On the basis of comparisons of the laboratory samples produced, it was found that the initially produced laboratory samples had longer chips than the later produced laboratory samples and it was finally found that this reduction of the long chips is caused by the wearing of the chipper knives.

If, therefore, wood product plates would be produced with the above-mentioned construction, then no wood product plates could be manufactured having a uniform longitudinal bending resistance, so that the purpose of the invention is to provide an installation for the series manufacturing of such chips with which wood product plates having a constant longitudinal bending strength can be produced even if during the period of use of the chipper knives the average length of the chips decreases.

SUMMARY OF THE INVENTION

To solve this problem it is suggested according to the invention to provide firstly a chipper which produces more chips or the like of as large as possible a length than are required to form the cover layer or the cover layers of a mat, that behind the chipper there is provided at least one wet bunker and at least one dryer, and that the siding device is a siding device which separates the chips or the like that remain after the segregation of the fine material and the dust into two fractions, of which the chip composition of the one fraction during the manufacturing time contains constantly chips of maximum possible length and more of these than are required for the mat cover layer or the mat cover layers, whereas the second fraction is composed of shorter chips or the like produced during the chipping, that for both fractions there is provided at least one bunker each, and that a feeding device is provided which feeds a part of the long chips of the first fraction to the chips of the second fraction.

In this manner it is assured that during the production of a mat—not only when the chipper is shut down to change knives, but particularly also during the period of use of the chipper knives during which the average length of the chips decreases—there are always sufficient chips of a first fraction having the maximum possible length, which are admitted in constant quantity ratios into the cover layer or cover layers of the mat, so that the wood product plates or the like to be produced therefrom always have a uniform longitudinal bending strength.

The invention will hereafter be described with reference to an exemplary embodiment, referring to the drawing and by comparison to the state of the art known from actual practice.

BRIEF DESCRIPTION OF THE DRAWING

FIG. 1 shows a schematic diagram of an installation which, erected based upon laboratory tests, could be considered evident to a specialist, having only one bunker for the cover layer and middle layer material, which is then followed by at least one not illustrated gluing device.

FIG. 2 shows a diagrammatic illustration of a further developed installation according to the present invention with a cover-layer bunker and a middle-layer bunker, the chip material or the like is subsequently provided with at least one binder material, and FIG. 3 shows a part of the exemplary embodiment of FIG. 1 with three bunkers, namely two cover layer bunkers and one middle layer bunker.

DESCRIPTION OF THE PREFERRED EMBODIMENTS

At the beginning of the production raw material 1 was so chipped in a chipper 2 (FIG. 1) that chips of maximum possible length were obtained for the laboratory tests. Whereas in laboratory tests one can use already dried chipping material or the like, it is necessary in series production to arrange behind a chipper first a wet chip bunker 3 and then a dryer 4, in order to obtain dried relatively long chips. To segregate fine material and dust components from the chipped goods, a sifter 5 was then used which removed the fine material and the dust fraction in the direction of the arrow 6, whereas the chipped good segregated from these particles issued in the direction of the arrow 7 and was then supplied to the orienting devices to be tested. In the series manufacture for the continuous production of mats serving to produce wood material plates one will use a bunker 8 in which the chipped good segregated from the fine material and the dust will be stored.

Since hereinbefore the same material was supplied both to the two cover layers of the mat as well as to the middle layer of the mat, it is shown in FIG. 1 that the cover layer material is withdrawn from the bunker 8 in direction of the arrows 9, 10 and that the middle layer material for formation of a third layer leaves the bunker in the direction of the arrow 11. In the example to be examined there are thus provided three orientation devices behind one another above a movable substrate, on which the mat is to be produced.

The chips serving for the formation of the individual layers, have, as a rule, a length of between approximately 40 mm and 70 mm, a width of approximately 5 mm to 10 mm and a thickness of approximately 0.3 mm to 0.7 mm. So that there is always a sufficient quantity of chips to be deposited and to be generally parallel oriented in their individual layers, one will use at least one wet chip bunker. The size of the thereafter following dryer 4 is also accommodated to the minimum chip quantity that is needed. The fine material and dust segregated from the dried chip material are used for other purposes.

Since the material collected in the bunker 8 and partially stored for the production of a cover layer or for the production of two cover layers and of a middle layer of a mat must be withdrawn for this purpose, the bunker empties by a certain measure, and this bunker is refilled by newly chipped material. The longer the chipper with the chipping tools operates, the less he produces chips of uniform length, as at the beginning of the chipping with new tools; thus, the quantity of relatively long chips becomes smaller whereas the quantity of shorter chips increases. This is the reason for the reduction in the longitudinal bending strength of wood product plates produced from said mats.

In order to make an accommodation one could, now, either replace the chipping tools after a relatively short working time by others or one could use two chippers which operate one after the other, supplied with new tools, to produce chips of maximum possible length, but this requires rather a substantial expenditure.

This expenditure can be avoided if one, as shown in FIG. 2, first supplies the raw material 1 to a single chipper 2' which according to the invention produces more chips of a preferably maximum length than are required for forming the cover layer or cover layers.

If one assumes, for example, that according to the diagram in FIG. 1 the wet chip bunker 3 contains 60 parts of relatively long chips 1 and 40 parts of shorter chips k produced by new chipping tools and 10 parts fine materials F and dust St, so that this wet chip bunker 3 contains a total of 110 parts, then in this case, 10 parts fine material F and dust St would be removed from the sifter 5 and the bunker 8 would receive 60 parts of relatively long chips 1 and 40 parts of relatively short chips k. Since the quantity of the relatively long chips decreases with increasing operating time of the chipper 2 and the quantity of shorter chips increases at the same time, the ratio 60:40 changes increasingly, so that all the time only relatively few chips of maximum length are available for mat formation.

If, however, one assures that the chipper 2' (FIG. 2), produces more and preferably relatively long chips 1 as suggested according to the present invention, and more of such chips than are needed for forming the cover layer (s) of the mat, then there will be present in the wet chip bunker 3' more cover layer material than in the wet chip bunker 3 (FIG. 1). The dryer 4' is to be constructed somewhat larger than the dryer 4 in FIG. 1, in order to be able to dry the volumetrically larger chip quantity if possible in the same period of time. The also larger sifter 5' now removed not only the fine material and the dust in the direction of the arrow 6', it also separates the goods passing through it in the direction of the arrow 12 into chips 1 of maximum possible length and in the direction of the arrow 13 in shorter chips k which are introduced into a cover layer bunker 14 respectively into a middle layer bunker 15. The volume of the cover layer 14 and the middle layer bunker 15 is thus larger than the volume of the bunker 8 in FIG. 1.

Since an excess of maximum length chips is stored in the cover layer bunker 14, this bunker thus contains more than 60 parts of maximum length chips 1 (see the explanation relative to FIG. 1) and the middle layer bunker 15 contains fewer than 40 parts of shorter chips k; because of this, a distributor device indicated by the arrow 16 supplies according to the invention a part of the maximum length chips in the bunker 14 to the shorter chips leaving the bunker 15, so that the requisite ratio of relatively long chips to shorter chips is obtained again over a certain period of time. In the bunker 14 containing the cover layer material there is thus over a period of time corresponding to the time within which the chipping tools are to be replaced, always a sufficient quantity of maximum length chips, whereas during this time, there is also present in the middle layer material-containing bunker 15 a sufficient quantity of shorter chips. The wet chip bunker 3' contains during the down time of the chipper 2' sufficient quantities of the later obtained two fractions.

The exemplary embodiment of FIG. 3 differs from the embodiment of FIG. 1 only in that the sifter 5'' supplies the cover layer material to two cover layer layer bunkers 17 and 18 and the middle layer material to a middle layer material bunker 19, and in that it has two distributing devices designated by arrows 20 and 21 via which from the bunker 17 as well as from the bunker 18 a part of maximum-length chips is supplied to the shorter chips removed from the middle layer bunker 19. When the chipper 2' (FIG. 2) produces substantial quantities of relatively long chips, preferably having a length of approximately 70 mm and greater, then the longitudinally bending strength of the wood product chip plates to be produced can be even increased beyond the measure which heretofore could be obtained in laboratory tests. In this instance, it is even possible to obtain, given a relatively high cover layer material proportion, to obtain longitudinal bending strength values which in comparison to solid wood in form of beams and squared timber are for the first time equal to the values of such beams and squared timber. In this connection reference is made to the hereafter following data. Wood product plates were produced from fir chips. Different pouring conditions are identified and the tested values are shown, with binder material being used in form of 6% phenolformaldehyde resin (liquid) and 1.2% paraffin, both values being related to atro chips:

| Pouring Condition DS:MS:DS | $\frac{1}{3}:\frac{1}{3}:\frac{1}{3}$ DS oriented MS oriented | $\frac{1}{3}:\frac{1}{3}:\frac{1}{3}$ DS oriented MS homogeneous | 1/7:5/7:1/7 DS oriented MS oriented |
|---|---|---|---|
| Thickness (mm) | 12 | 12 | 12 |
| Raw Thickness (kg/m3) | 650 | 650 | 650 |
| Bending Strength 11 (N/mm2) | 54.1 | 56 | 38.5 |
| Bending Strength 1 (N/mm2) | 19.0 | 18.5 | 31.5 |
| Transverse Tensile Strength (n/mm2) | 0.64 | 0.65 | 0.62 |
| Linear Extension II (%) | 0.10 | 0.12 | 0.15 |
| (20°,50/90% r.1) I (%) | 0.14 | 0.15 | 0.20 |
| Swelling (thickness) 24 h (%) | 12.8 | 13.5 | 13.2 |

What is claimed is:

1. A method for processing of ligno-cellulose containing particles for the manufacture of wood-product plate type articles having layers of oriented chips, comprising the steps of: comminuting raw material by chipper means; separating fine material and dust by sifting means; providing sifted chips with at least one binder material by gluing means; producing with said chipper means more chips of as great a length as possible than are required for forming of at least one cover layer of a mat; locating wet chip bunker means behind said chipper means and locating dryer means following thereof; separating chips obtained after removal of the fine material and the dust into two fractions by said sifting means, one of said fractions during processing time constantly containing chips which are as long as possible and which are more than that required for forming said mat cover layer, the other one of said fractions having shorter chips obtained during chipping, both fractions being present each in at least one bunker; supplying by feeding means a part of the chips that are as long as possible from said one fraction to the chips of said other fraction, so that resistance against longitudinal bending is uniform in said wood-product plate type articles.

2. An arrangement for processing of ligno-cellulose containing particles for the manufacture of wood-product plate type articles having layers of oriented chips, comprising: chipper means for comminuting raw material; sifting means for separating fine material and dust; gluing means for providing sifted chips with at least one binder material; said chipper means producing more chips of as great a length as possible than are required for forming of at least one cover layer of a mat; wet chip bunker means behind said chipper means and dryer means following thereof; said sifting means separating chips obtained after removal of the fine material and the dust into two fractions, one of said fractions during processing time constantly containing chips which are as long as possible and which are more than that required for forming said mat cover layer, the other one of said fractions having shorter chips obtained during chipping, both fractions being present each in at least one bunker; feeding means for supplying a part of the chips that are as long as possible from said one fraction to the chips of said other fraction, so that resistance against longitudinal bending is uniform in said wood-product plate type articles.

3. Apparatus as defined in claim 2, wherein said feeding means is arranged between said sifting means and said bunker.

* * * * *